United States Patent [19]

Despot

[11] 4,362,102

[45] Dec. 7, 1982

[54] SHAFT SEAL FOR DISTRIBUTOR ROLLERS IN INKING UNITS OF PRINTING PRESSES

[75] Inventor: Janko Despot, Offenbach am Main, Fed. Rep. of Germany

[73] Assignee: M.A.N.-Roland, Druckmaschinen Aktiengesellschaft, Fed. Rep. of Germany

[21] Appl. No.: 227,427

[22] Filed: Jan. 22, 1981

Related U.S. Application Data

[63] Continuation-in-part of Ser. No. 218,824, Dec. 22, 1980, abandoned.

[30] Foreign Application Priority Data

Dec. 21, 1979 [DE] Fed. Rep. of Germany ..... 2951652

[51] Int. Cl.[3] ..... B41F 31/14; B41L 27/16

[52] U.S. Cl. ..... 101/348; 101/DIG. 14; 308/187.1

[58] Field of Search ..... 101/DIG. 14, 348, 349, 101/350, 248, 205, 206; 308/187, 187.1, 187.2, 189 R, DIG. 11, 58, 59; 277/136, 53

[56] References Cited

U.S. PATENT DOCUMENTS

| | | | |
|---|---|---|---|
| 2,653,538 | 9/1953 | Peyrebrune | 101/248 |
| 2,851,315 | 9/1958 | Zavoda | 308/187.1 |
| 2,948,216 | 8/1960 | Thompson | 101/248 |
| 3,614,183 | 10/1971 | Berens | 308/187.1 |
| 3,704,669 | 12/1972 | Christoff | 101/349 |
| 3,750,568 | 8/1973 | Weisgerber | 101/248 |
| 3,841,723 | 10/1974 | Kelso | 308/187.1 |
| 4,015,883 | 4/1977 | Taylor | 308/187.1 |
| 4,195,854 | 4/1980 | Bertin | 308/187.1 |

*Primary Examiner*—J. Reed Fisher

*Attorney, Agent, or Firm*—Leydig, Voit, Osann, Mayer and Holt, Ltd.

[57] ABSTRACT

An assembly for journaling and sealing the shaft of a reciprocated roller in a printing press. Mounted on the shaft adjacent the roller is an anti-friction bearing which reciprocates with the shaft. A supporting sleeve is secured to the outer race of the bearing interposed between the bearing and the wall of the opening in the frame and telescoped over the projecting portion of the shaft, the sleeve being keyed to the frame to prevent relative rotation of the sleeve while permitting reciprocation of the sleeve with the shaft. A sealing ring has a collar which is recessed in the telescoping portion of the sleeve. The collar mounts on an annular lip of impervious resilient material extending therefrom cantilever-fashion and shaped to produce a narrow ring of contact with the projecting portion of the shaft, the lip being encircled by a garter spring so that sealing force is applied radially inwardly around the entire ring of contact. The collar of the sealing ring is fixed to the sleeve so that the ring of contact remains axially stationary with respect to the shaft as the shaft undergoes reciprocating movement.

4 Claims, 1 Drawing Figure

SHAFT SEAL FOR DISTRIBUTOR ROLLERS IN INKING UNITS OF PRINTING PRESSES

Figure 1:
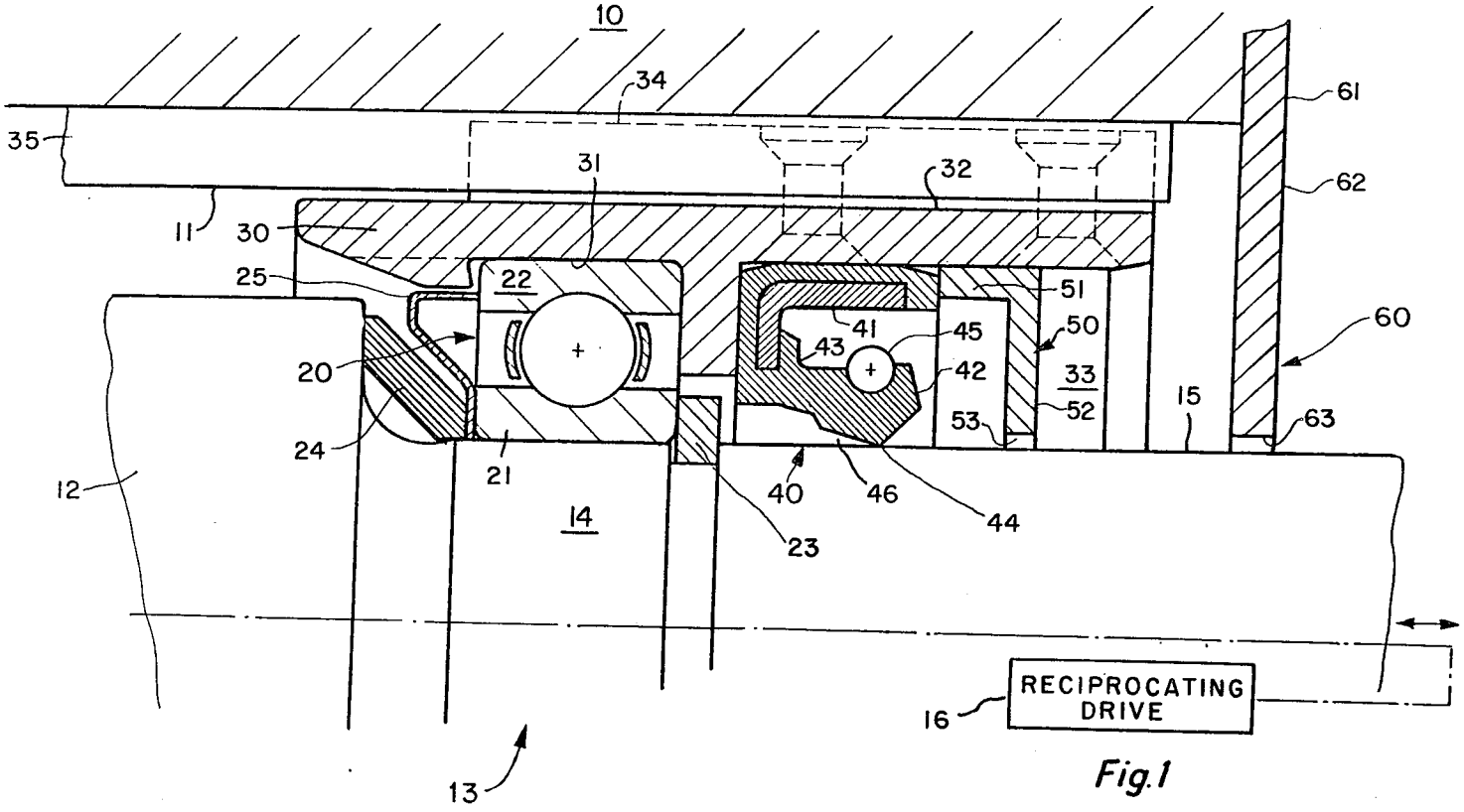

This is a continuation-in-part of application Ser. No. 218,824 filed Dec. 22, 1980, now abandoned.

In the feeding of ink to the plate cylinder of a printing press a set of distributor rollers are normally provided for spreading the ink into a film of constant thickness, a portion of the distributor rollers being not only rotated but reciprocated, or "vibrated", axially through a small amplitude by a special reciprocating drive. To prevent lubricant from the bearing from escaping along the roller shaft, it has been known to provide, adjacent each bearing, a stationary seal made of resilient material cooperating with the shaft surface. Where the rollers simply rotate a seal can be achieved which is effective and has a long useful life, but where the seal must accommodate both shaft rotation and reciprocation the effectiveness of the seal in containing lubricant is degraded and the life of the seal is shortened resulting in leakage, particularly during operation at high speed.

It is, accordingly, an object to provide an assembly for journaling and sealing the shaft of a reciprocated, or "vibrated", roller which is more effective and which has a longer useful life than sealing arrangements customarily employed. It is more specifically an object to provide a sealing arrangement for a reciprocated roller in which the bearing is enclosed in, and secured to, a supporting sleeve which extends along the projecting portion of the shaft, with a resilient sealing ring being secured within the sleeve so that the ring of contact between the sealing ring and the shaft remains axially stationary with respect to the shaft as the shaft undergoes reciprocating movement.

It is a general object to provide a bearing and sealing arrangement for a reciprocated roller which is not only efficient and maintenance-free but which can be produced as an economical and compact subassembly having general utility.

Other objects and advantages of the invention will become apparent upon reading the attached detailed description and upon reference to the drawing in which:

FIG. 1 is a partial section taken through the axis of the roller shaft and showing the journaling and sealing arrangement of the present invention.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Turning now to the drawing there is shown a portion of a printing press frame 10 having a shaft clearance opening defined by a wall 11. Centrally mounted with respect to the opening is a roller 12 having a shaft 13 which includes an adjacent portion 14 and a projecting portion 15. The shaft is, during the normal operation of the press, reciprocated or "vibrated" by means of a reciprocating drive indicated at 16 and which is per se well known to those skilled in the art.

For journaling the shaft an anti-friction bearing 20 is provided having an inner race 21 and an outer race 22, the inner race being mounted upon the adjacent portion 14 of the shaft and held captive against axial movement by a retaining ring 23 and supporting ring 24 which engage opposite sides of the inner race. Sandwiched in between the supporting ring and the inner race is an inboard sealing ring, or cap 25.

In accordance with the present invention a supporting sleeve is secured to the outer race of the bearing interposed between the bearing and the wall of the opening in the frame, telescoped over the projecting portion 15 of the shaft, and keyed to the frame to prevent rotation of the sleeve while permitting bodily reciprocation with the shaft. Thus the supporting sleeve, indicated generally at 30, has a recess 31, in which the outer race of the bearing is held captive, and a telescoping portion 32 which extends along the projecting portion 15 of the shaft to define an annular recess 33. To prevent rotation of the sleeve, while permitting the sliding movement referred to, the sleeve has, secured to it, a key 34 which acts as a radial projection, or spline, extending alongside a key-retaining surface which may be in the form of a guide bar 35.

Further in accordance with the invention, a sealing ring is recessed in the telescoping portion of the sleeve, the sealing ring having a collar with an annular lip of impervious, resilient material mounted thereon cantilever-fashion, the annular lip being shaped to form a narrow ring of contact with the projecting portion of the shaft, the collar of the sealing ring being fixed to the sleeve so that the ring of contact remains axially stationary with respect to the shaft as the shaft undergoes reciprocating movement.

Thus I provide in the annular recess 33 of the sleeve a sealing ring 40 having a collar 41 and a lip 42 which is of annular shape, the lip 42 being formed of rubber-like material integrally connected to the collar "cantalever-fashion" at a region 43 of relatively narrow cross section. The lip is shaped to form a narrow ring of contact 44 with the shaft. A garter spring 45, encircling the lip, causes the lip to apply sealing force radially inwardly about the entire ring of contact.

The ring of contact is lubricated by a quantity of lubricant which is contained in a space 46 between the lip of sealing ring and the shaft on the bearing side of the ring of contact.

It is an important feature of the invention that the collar 41 of the sealing ring 40 is axially captive with respect to the sleeve. Thus, as the roller is reciprocated by the reciprocating drive 16, the bearing reciprocates the sleeve which, in turn, reciprocates the sealing ring so that the latter remains axially stationary with respect to the roller shaft rather than scraping back and forth along it as occurs in more conventional constructions.

In accordance with one of the aspects of the present invention there is provided, within the telescoping portion of the sleeve on the outboard side of the ring of contact, a lubricant retaining ring which extends to within a close clearance distance on the shaft for retaining any lubricant which may escape from the ring of contact and which may be flung outwardly from the shaft by centrifigul action during high speed rotation. Such lubricant retaining ring, indicated at 50, has cylindrical collar, or cylindrical flange, 51 and an annular portion 52 which extends radially inwardly terminating at a clearance opening 53 which is positioned close to the shaft. The collar, or flange, 51 of the retaining ring is preferably dimensioned for a press fit into the sleeve so that in addition to its retaining function it serves to hold the collar 41 of the sealing ring axially captive.

As further insurance against leakage of lubricant there is provided a second annular lubricant retaining ring spaced from the first retaining ring 50 in the outboard direction for retaining any lubricant which may get by the first retaining ring. Such second retaining ring, indicated at 60, has an anchoring portion 61 secured to the frame 10 and an annular portion 62 which extends radially inwardly terminating at a clearance opening 63 which closely surrounds the projecting portion of the shaft.

It is found that such sealing arrangement is highly effective against the escape of lubricant. In spite of the fact that the shaft reciprocates endwise, the ring of contact 44 of the resilient sealing element is relatively stationary accounting for the effectiveness of the seal as well as long life and freedom from maintenance. In addition, any lubricant which may get by the seal, particularly during high speed operation, and which may be flung outwardly by centrifugal force, is held captive within the lubricant retaining ring 50 which is also bodily reciprocated with the shaft. Finally, any lubricant which may possibly find its way along the shaft within the first clearance opening 53, and which may be discharged therefrom by centrifigul force, is retained by the second retaining ring 60 which is stationarily mounted and which does not reciprocate with the shaft.

It is apparent that the objects of the invention have been amply fulfilled. Not only is the bearing and sealing arrangement efficient and maintenance-free but it also is susceptible to economical manufacture as a compact sub-assembly having general usage in the mounting of distributor rollers, both reciprocated and non-reciprocated.

While the sleeve 30 has been described as being keyed to an opening in the frame of the press, it will be understood that the term "frame" is a general one including within its scope not only the actual frame but any bracket or floating mounting which is secured to the frame and which thereby provides transaxial adjustment of the roller position. The term "garter spring" applied to the element 45 will be understood to mean any spring exerting force radially inwardly about the ring of contact with the shaft.

I claim as my invention:

1. Means for journaling and sealing a reciprocated roller in a printing press comprising, in combination, a reciprocated roller having a shaft, a press frame having an opening through which the shaft extends, an anti-friction bearing adjacent the roller and having an inner race and outer race, means for holding the inner race axially captive on the shaft so that the bearing reciprocates with the shaft, the shaft having a portion projecting outboard beyond the bearing, a supporting sleeve secured to the outer race of the bearing interposed between the bearing and the wall of the opening in the frame and telescoped over the projecting portion of the shaft to form an annular recess, means for keying the sleeve to the frame to prevent relative rotation of the sleeve in the frame while permitting reciprocation of the sleeve with the shaft, a sealing ring recessed in the telescoping portion of the sleeve, the sealing ring having a collar with an annular lip of impervious resilient material mounted thereon cantilever-fashion, the annular lip being shaped to form a narrow ring of contact with the projecting portion of the shaft and having a garter spring in encircling relation so that sealing force is applied radially inwardly about the entire ring of contact, the collar of the sealing ring being fixed to the sleeve so that the ring of contact remains axially stationary with respect to the shaft as the shaft undergoes reciprocating movement.

2. The combination as claimed in claim 1 in which a quantity of lubricant is contained between the lip of the sealing ring and the shaft on the bearing side of the ring of contact, an annular lubricant retaining ring secured in the telescoping portion of the sleeve on the outboard side of the ring of contact and extending to within a close clearance distance of the shaft for retaining any lubricant which may escape from the ring of contact and which may be flung outwardly from the shaft by centrifugal action during high speed rotation.

3. The combination as claimed in claim 1 in which a quantity of lubricant is contained between the lip of the sealing ring and the shaft on the bearing side of the ring of contact, an annular lubricant retaining ring secured to the frame on the outboard side of the ring of contact and extending to within a close clearance distance of the projecting portion of the shaft for retaining any lubricant which may get by the ring of contact and which may be flung outwardly from the shaft by centrifigul action during high speed rotation.

4. The combination as claimed in claim 1 in which a quantity of lubricant is contained between the lip of the sealing ring and the shaft on the bearing side of the ring of contact, a first annular lubricant retaining ring secured in the telescoping portion of the sleeve on the outboard side of the ring of contact and extending to within a close clearance distance of the shaft for retaining any lubricant which may escape from the ring of contact and which may be flung outwardly from the shaft by centrifigul action during high speed rotation, and a second annular lubricant retaining ring spaced from the first retaining ring in the outboard direction for retaining any lubricant which may get by the first retaining ring.

* * * * *